US005974279A

United States Patent [19]

Slabbaert et al.

[11] Patent Number: 5,974,279

[45] Date of Patent: Oct. 26, 1999

[54] PROCESS CONTROL OF ELECTROPHOTOGRAPHIC DEVICE

[75] Inventors: Jean-Pierre Slabbaert, Boechout; Robert Janssens, Geel; Dirk Broddin, Edegem; Werner Heirbaut, St. Niklaas, all of Belgium

[73] Assignee: AGFA Gevaert N.V., Mortsel, Belgium

[21] Appl. No.: 08/891,932

[22] Filed: Jul. 14, 1997

Related U.S. Application Data

[60] Provisional application No. 60/028,076, Sep. 30, 1996.

[30] Foreign Application Priority Data

Jul. 18, 1996 [EP] European Pat. Off. ..... 96201041

[51] Int. Cl.[6] ..... G03G 15/06

[52] U.S. Cl. ..... 399/61; 399/49

[58] Field of Search ..... 399/47, 48, 49, 399/53, 61, 62

[56] References Cited

U.S. PATENT DOCUMENTS 4,026,643 5/1977 Bergman .
5,005,050 4/1991 Donivan .
5,006,897 4/1991 Rimai et al. ..... 399/61
5,047,802 9/1991 Donivan et al. ..... 399/53
5,212,522 5/1993 Knapp .
5,307,119 4/1994 Folkins .

FOREIGN PATENT DOCUMENTS 0 276 107 7/1988 European Pat. Off. .
0 510 325 10/1992 European Pat. Off. .

*Primary Examiner*—Fred L. Braun
*Attorney, Agent, or Firm*—Edward L. Kelley; John A. Merecki

[57] ABSTRACT

A method for controlling the density of microdots produced by a binary or multilevel electrophotographic device. In one example, the toner concentration in a two-component developing system is modified as to keep the toner charge Q/M approximately constant. The toner charge is indirectly assessed. This allows to achieve consistent output densities, irrespective of the environmental parameters, such as relative humidity and temperature.

9 Claims, 8 Drawing Sheets

PROCESS CONTROL OF ELECTROPHOTOGRAPHIC DEVICE

This application claims priority from Provisional Application number 60/028,076 filed Aug. 30, 1996.

FIELD OF THE INVENTION

The present invention relates to devices and methods for an image forming apparatus, such as an electrophotographic digital copying machine or digital printer with a two-component development system.

BACKGROUND OF THE INVENTION

One of the main factors to quantify the quality of a printed image is the tone scale representation, expressed by the optical density range and the exactness and stability of the contone rendering. In a digital printing machine, such as an electrophotographic engine, each tone of a contone image is produced by a certain spatial combination of some or all of the available tones per pixel. This process is referred to as screening. The set of tones, available in the machine, is defined by the properties of the exposure device. For instance, in an electrophotographic printer that uses a binary exposure device, only two tones (black and white) are available to the screening algorithm to reproduce a contone image. In some machines however, multiple tone levels are available to the screening process by applying area or intensity modulation on the output spot of the exposure device (see below). As screening is well-defined and, by its nature, perfectly repeatable, the image quality of the engine is largely determined by the ability to reproduce the set of tones. In an electrophotographic engine the contone density of each microdot is determined by the mass of toner per unit area transferred to paper. This toner mass, referred to as M/A and expressed in mg/cm$^2$, is a function of an almost limitless amount of parameters. Most of these parameters can be regarded as fixed by design and thus invariable during the operation of the engine. Some however are extremely variable. The most important in a two-component developer system are:

- toner concentration (TC)=the ratio of the amount of toner and the amount of carrier available in the developing unit in a two-component system.
- toner charge per unit of mass (Q/M), expressed in $\mu$C/g.
- development potential ($V_{DEV}$), expressed in Volt=the potential difference $V_E-V_B$ over the development gap between the developer supply roller (bias voltage $V_B$) and the photosensitive element (voltage after exposure $V_E$) upon which a latent image is present. The photosensitive element is mostly implemented as an Organic Photoconductor or OPC.
- transfer efficiency (TE), expressed in %: the ratio of the amount of toner transferred to the printing medium and the amount of toner developed on the photosensitive element. This dependency can be formally expressed as:

$$M/A=f(TC,\ Q/M,\ V_{DEV}TE)$$

and is generally referred to as the developability and transferability f( ) of the toner.

In an electrophotographic engine, the reproduction of multiple tones is highly sensitive to each of these variables. Toner concentration TC changes during engine operation due to depletion of toner caused by image development and toner addition under control of the engine. Toner charge Q/M is determined by:

- the triboelectric properties of toner and carrier,
- toner concentration TC,
- relative humidity RH of the air in the developing unit,
- agitation of developer in the developing unit.

When the developer is properly agitated, an unambiguous relationship can be found between Q/M, TC and RH. The development potential $V_{DEV}$ is determined by:

- the initial charge level $V_C$ of the OPC,
- the bias voltage $V_B$ applied to the toner supply roller of the developing unit and
- the intensity $E_{EXP}$ of the image dependent illumination of the photosensitive element.

Transfer efficiency TE on its turn is, amongst other factors, determined by:

- toner charge Q/M,
- amount of toner on the photosensitive element and
- the value of the electric field in the transfer zone.

Present electrophotographic machines maintain the optical density of their produced tones by keeping toner concentration TC at a constant level. For this purpose they use a toner concentration sensor in the developing unit, or a density sensor that measures the density $D_{OPC}$ developed on the OPC, or both. Changes of the toner charge Q/M, due to relative humidity RH or variations of RH are compensated for by changing the development potential $V_{DEV}$ and the value of the transfer electric field. Disadvantages of this technique are:

- extremely low toner charge Q/M at high relative humidity RH, leading to an increase in dust production, fogging and possibly inconsistent transfer quality over the whole tone scale.
- extremely high toner charge at low relative humidity, decreasing the developability of the toner. This requires large electric fields in the developing stage and consequently implies more powerful engine hardware.

Furthermore, it can be shown that for a two-component developing system, the development of the latent image is almost purely driven by toner charge Q/M. Therefore toner charge Q/M would be a valuable input to any process control system for steering the electrophotographic process. Generally, online toner charge measurement Q/M can not be implemented easily without the need for high precision measurement hardware, which leads to an increase in system variable cost. As stated before, producing several tones in an electrophotographic engine can be done by area modulation or by intensity modulation of the light beam of the exposure device (or by any combination of both). In this way, a set of microscopic tones at the pixel or microdot level are created. These form a microscopic gradation that has to be kept constant for the contone rendering, handled by the screening process, to be repeatable.

OBJECTS OF THE INVENTION

It is therefore a first object of the present invention to provide a process control method that maintains quality contone rendering and at the same time avoids negative effects such as excessive dust creation, fogging, deteriorated transfer on paper and necessity of strong electric fields.

It is a further object of the invention to provide a method of measuring toner charge Q/M, online in the engine, without the need for any extra external hardware in the form of sensors or other measuring devices.

Further objects and advantages of the invention will become apparent from the description hereinafter.

SUMMARY OF THE INVENTION

The above mentioned objects are realised by the specific features according to claim 1. Preferred features of the invention are set out in the dependent claims.

These objects can be accomplished according to the present invention by an electrophotographic image forming apparatus as shown in FIG. 3. This apparatus comprises a charging device 2, such as a scorotron, that charges a photosensitive element 1, such as an Organic Photo conductor (OPC). The charged photoconductor 1 is exposed by an exposure device 3, such as a LASER, an LED-array, a spatial light modulator (like a DMD: deflective mirror device) etc., to form a latent image. The latent image is developed by a two-component developing system to form a toner image. The toner image is transferred to an output medium 22 such as paper or transparency and fused by applying heat and/or mechanical pressure. The apparatus preferentially comprises a densitometer 6 that measures the optical density D of the image developed on the OPC, preferably to correct the developing process for possible deviations. The apparatus contains a contact-less electrostatic voltage sensor 4 that measures the surface potential of the OPC 1. The apparatus preferably also contains a toner concentration sensor 16, preferentially located in the developing system 5. The developability and transferability of the toner particles are maintained over the complete range of environmental conditions, developer lifetime, etc. by keeping the charge of the toner, Q/M, within a narrow range. This range is defined by the unambiguous relationship between Q/M, TC and RH and the range for TC that can be allowed without penalizing developer lifetime. By changing the toner concentration TC by means of toner addition or toner depletion during operation of the engine, toner charge Q/M can be maintained at its required level. Toner charge Q/M may be indirectly measured, based upon the unambiguous relationship that exists between M/A, Q/M and $V_{DEV}$, for that range of M/A where development is not limited by toner supply (low- and midtones).

DETAILED DESCRIPTION OF THE INVENTION

The invention is described hereinafter by way of examples with reference to the accompanying figures wherein.

Figure 5D:
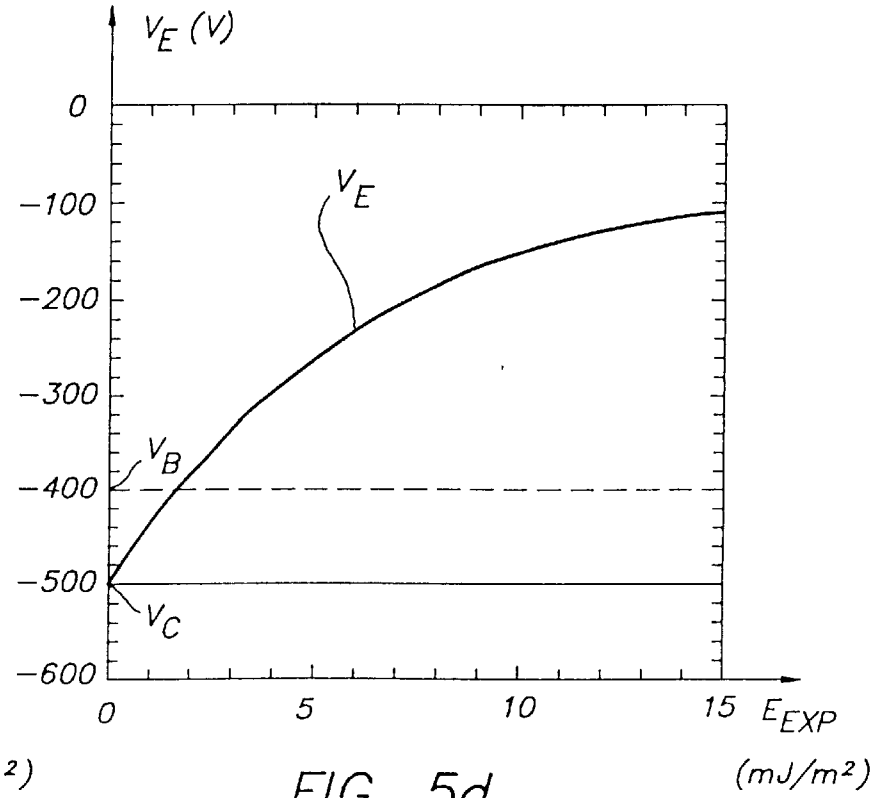
Figure 5A:
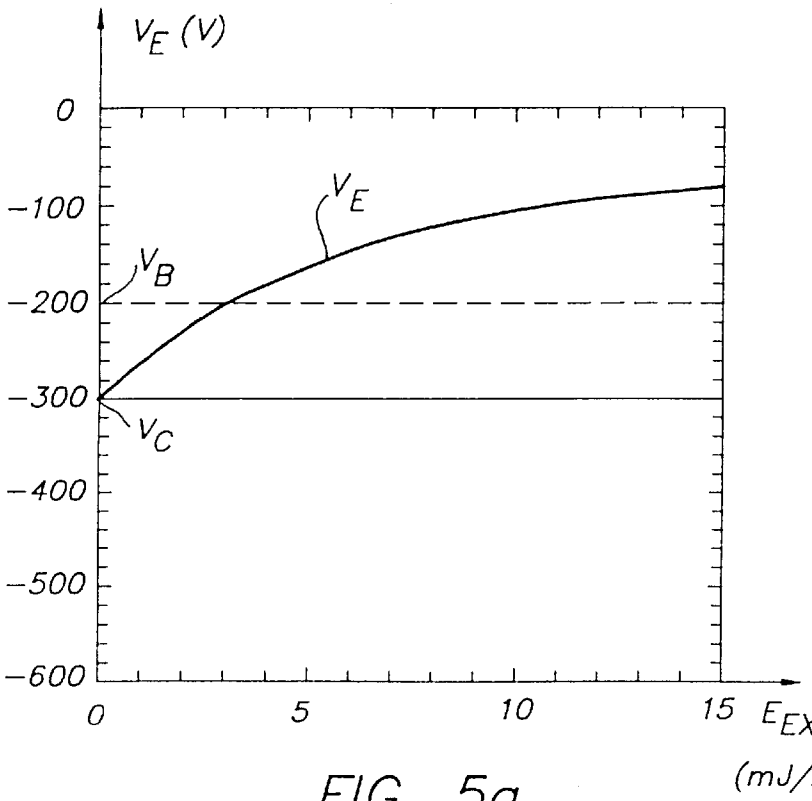
Figure 5E:
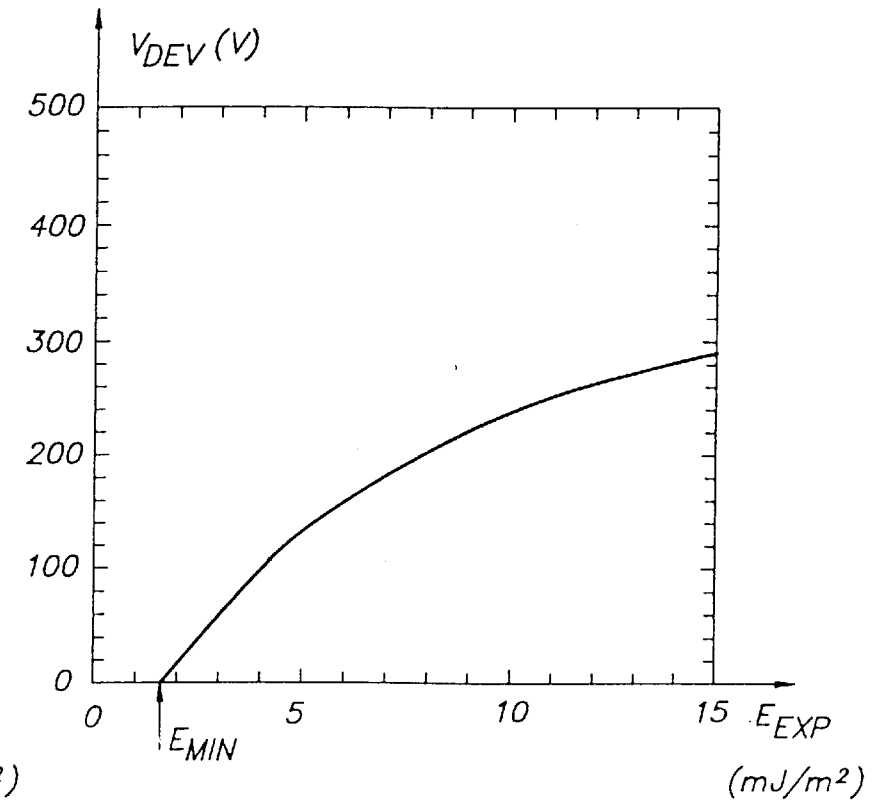
Figure 5B:
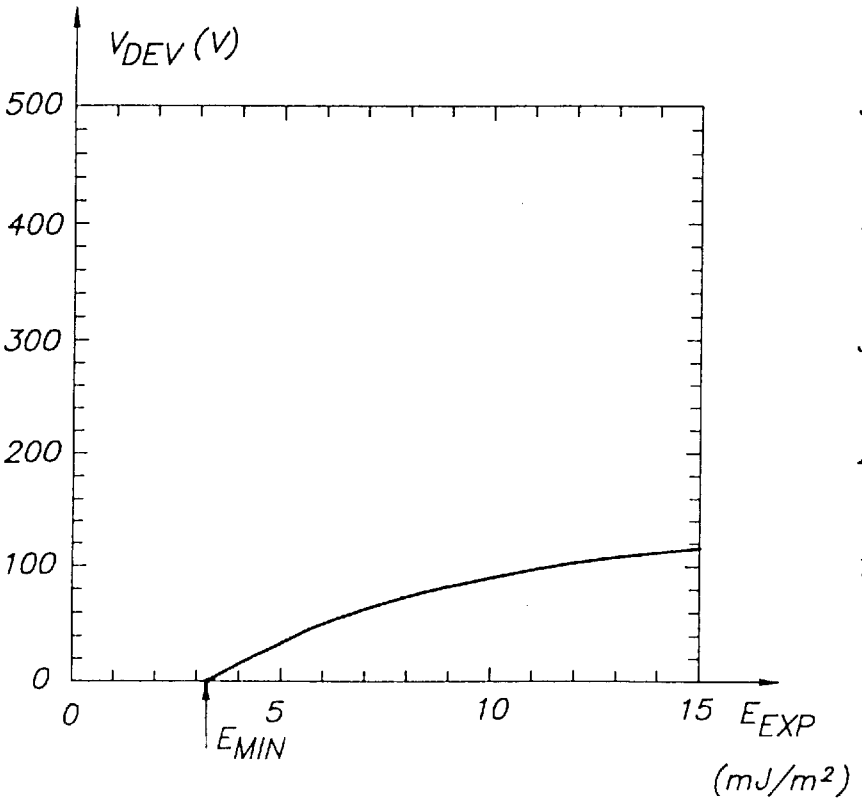
Figure 5F:
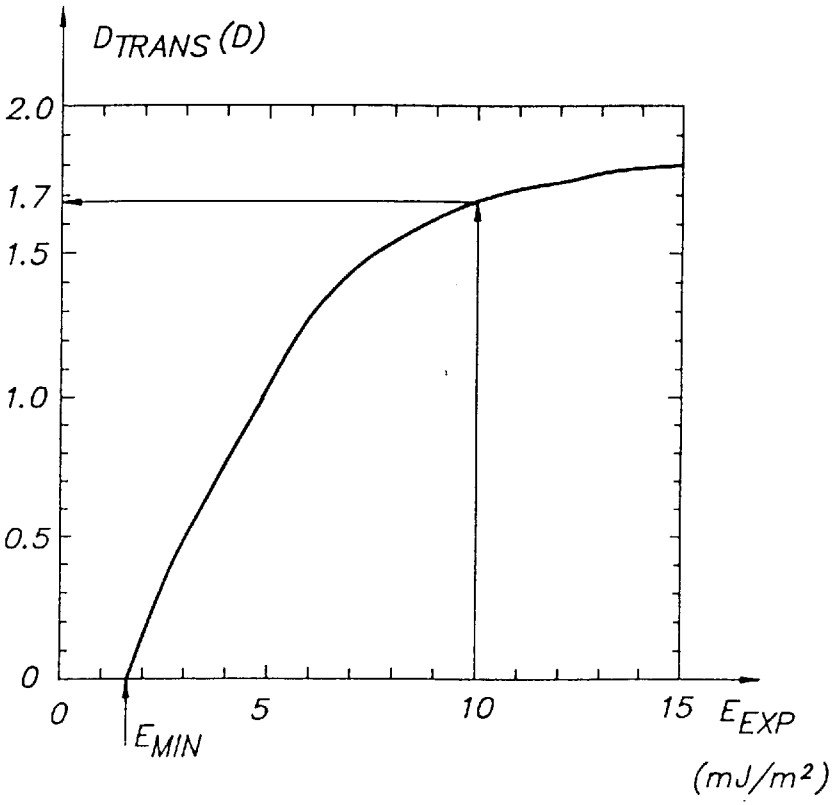
Figure 5C:
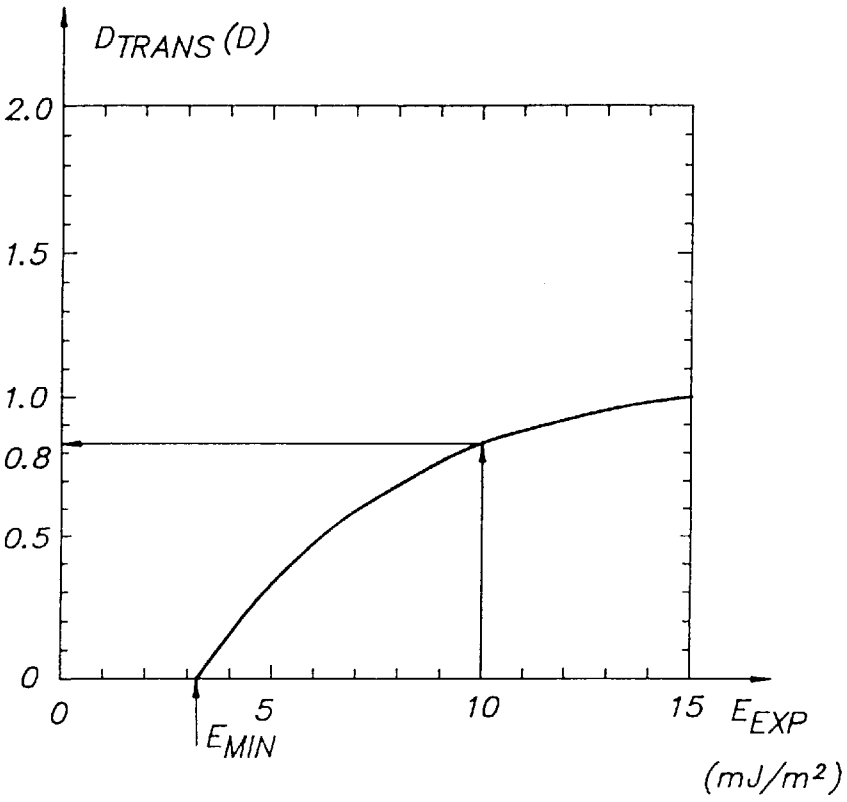

FIG. 5*a* represents the discharge potential $V_E$after exposure of the photosensitive element 1 by the exposure device 3, as a function of the amount of exposure energy $E_{EXP}$ along with a reference to the bias potential $V_B$=−200 V and the charge potential $V_C$=−300 V;

FIG. 5*b* represents the development potential $V_{DEV}=V_E-V_B$ as a function of the exposure energy $E_{EXP}$ for a charge potential $V_C$=−300 V;

FIG. 5*c* represents the transmission density $D_{TRANS}$ as a function of the exposure energy $E_{EXP}$ for a charge potential $V_C$=−300 V.

Figure 6:
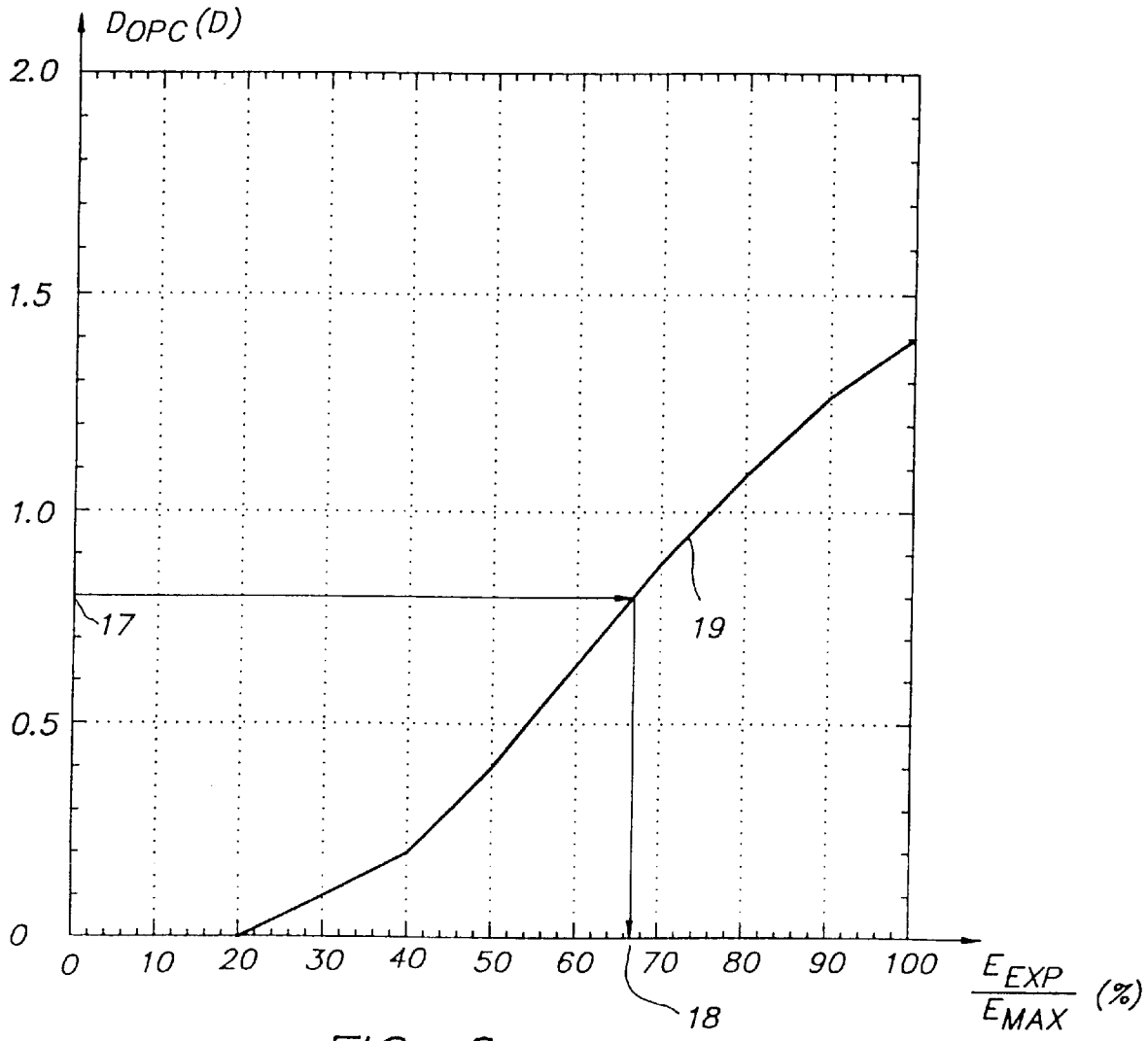

FIG. 5*d* represents the discharge potential $V_E$ after exposure of the photosensitive element 1 by the exposure device 3, as a function of the amount of exposure energy $E_{EXP}$, along with a reference to the bias potential $V_B$=−400 V and the charge potential $V_{C=-500}$ V;

FIG. 5*e* represents the development potential $V_{DEV}=V_E-V_B$ as a function of the exposure energy $E_{EXP}$ for a charge potential $V_C$=−500 V;

FIG. 5*f* represents the transmission density $D_{TRANS}$ as a function of the exposure energy $E_{EXP}$ for a charge potential $V_C$=−500 V;

FIG. 6 shows the density $D_{OPC}$ of 10 patches, as recorded with a densitometer, in a 10 step wedge with respect to relative exposure energy $E_{EXP}/(E_{EXP})_{MAX}$;

While the present invention will hereinafter be described in connection with preferred embodiments thereof, it will be understood that it is not intended to limit the invention to those embodiments. On the contrary, it is intended to cover all alternatives, modifications, and equivalents which are included within the scope of the invention as defined by the appending claims.

Electrophotographic engine

Figure 3:
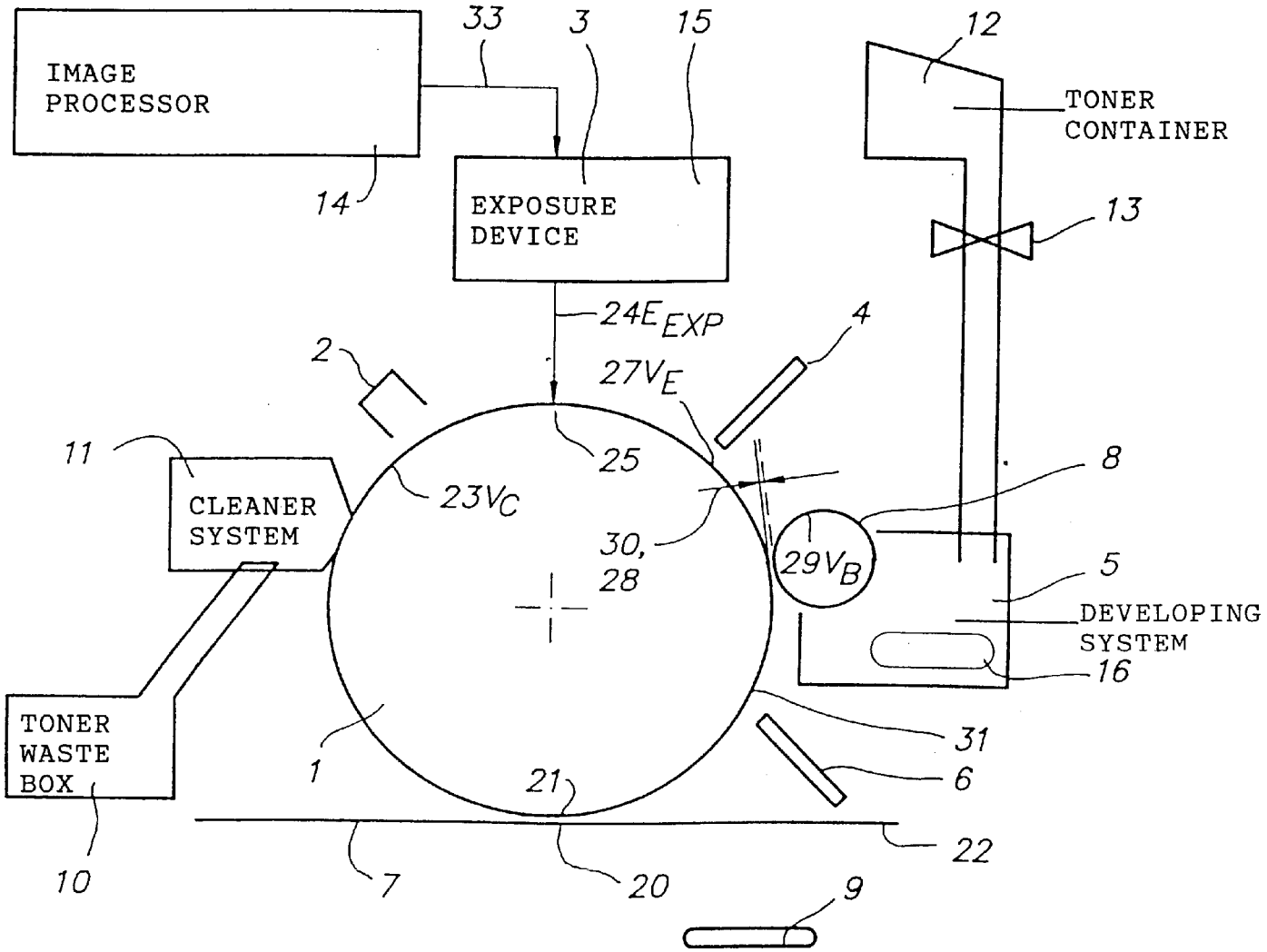
FIG. 3 represents an electrophotographic engine suitable for the current invention.

The most important components of an electrophotographic imaging apparatus suitable for the current invention are shown in FIG. 3. A photosensitive element 1, such as an OPC, is charged by a charging device 2 (such as a scorotron) and exposed by an exposure device 3 (laser scan system, LED-array, DMD, etc.). The exposure device 3 is capable of generating more than one exposure energy level $E_{EXP}$ per pixel. For instance a binary device can image two levels (0 and some other level different from 0), a 16-level (4 bit/pixel information) exposure device can generate 16 distinguishable levels per pixel (including 0), etc. The exposure device 3 receives image data 33 from an image processing unit 14, generally called a RIP or Raster Image Processor, which translates image data, presented in a page description language, to a bitmap. The bitmap contains the required exposure tone level I for each pixel in the image. Inside the exposure device 3 there is preferably a translation table 15 (look-up-table or LUT) to translate the data in the bitmap to physical exposure energy levels $E_{EXP}$. The effect of charging to a charge voltage $V_C$ and subsequently discharging by exposure $E_{EXP}$ can be measured by a contact-less electrostatic voltage sensor 4. The resultant latent image is developed by a two-component developing system 5. Charged toner particles are transferred from the magnetic brush 8 to the OPC surface by the force of the electric field $V_{DEV}$ present between the OPC surface at potential $V_E$ and the surface of the magnetic roller at potential $V_B$. The density $D_{OPC}$ 31 of the developed image can be measured with a densitometer 6 focused on the OPC surface. The engine comprises a toner container 12 from which toner can be added to the developing unit 5 through a control means 13. The developing unit 5 further preferably contains a toner concentration sensor 16 which is merely used as a watchdog for detecting extreme toner concentration values. The toner image is transferred to a medium 7 (paper, transparency, etc.). The engine also contains an environmental sensor 9 (referred to as RH/T sensor) that senses both relative humidity RH and temperature T. Toner particles that are not transferred to the medium 7 are scraped from the OPC by a cleaner system 11 and dumped into the toner waste box 10.

Definitions of terms (see FIG. 3)

The charge potential ($V_C$ 23) of the OPC is defined as the surface voltage with respect to ground after charging the OPC by means of a charging device 2 such as a scorotron and in absence of any exposure to light. The charge potential may be measured by a contact-less electrostatic voltage sensor such as a TREK model 856.

The potential after exposure or discharge potential ($V_E$ 27) is defined as the surface voltage of the OPC with respect to ground after charging the OPC followed by exposure $E_{EXP}$. The potential after exposure may be measured by a contact-less electrostatic voltage sensor such as a TREK model 856

The bias potential ($V_B$ 29) is the voltage of the sleeve of the magnetic roller 8 of the developing unit 5, with respect to ground.

The development potential ($V_{DEV}$ 30) is the difference $V_{DEV}=V_E-V_B$ between the potential after exposure $V_E$ 27 and the bias potential $V_B$ 29. When this value is negative, it is regarded as 'not-developing' and considered as set to a value of 0.

The cleaning potential ($V_{CL}$) is the difference $V_{CL}=V_B-V_C$ between the bias potential $V_B$ and the charge potential $V_C$ and is preferentially regarded as a fixed value.

the saturation potential ($V_{SAT}$) is the residual potential on the OPC, after a charge cycle followed by exposure with a limitless intensity value $E_{EXP}$. For every charge potential $V_C$ there is a constant value for $V_{SAT}$.

toner supply (TS): the amount of toner supplied to the developing gap 28 per second. TS is dependent on toner concentration TC, doctor blade distance, speed of the magnetic roller 8, etc.

toner concentration (TC): ratio of amount of toner to amount of carrier in the developing unit 5.

PID controller: Proportional, Integral and Differential controller, referring to a general control method, incorporating one, two or three of these techniques, as described in 'Modern Control Engineering' by K. Ogata, Prentice-Hall, Inc., Englewood Cliffs, N.J.

Measuring Q/M

Figure 1:
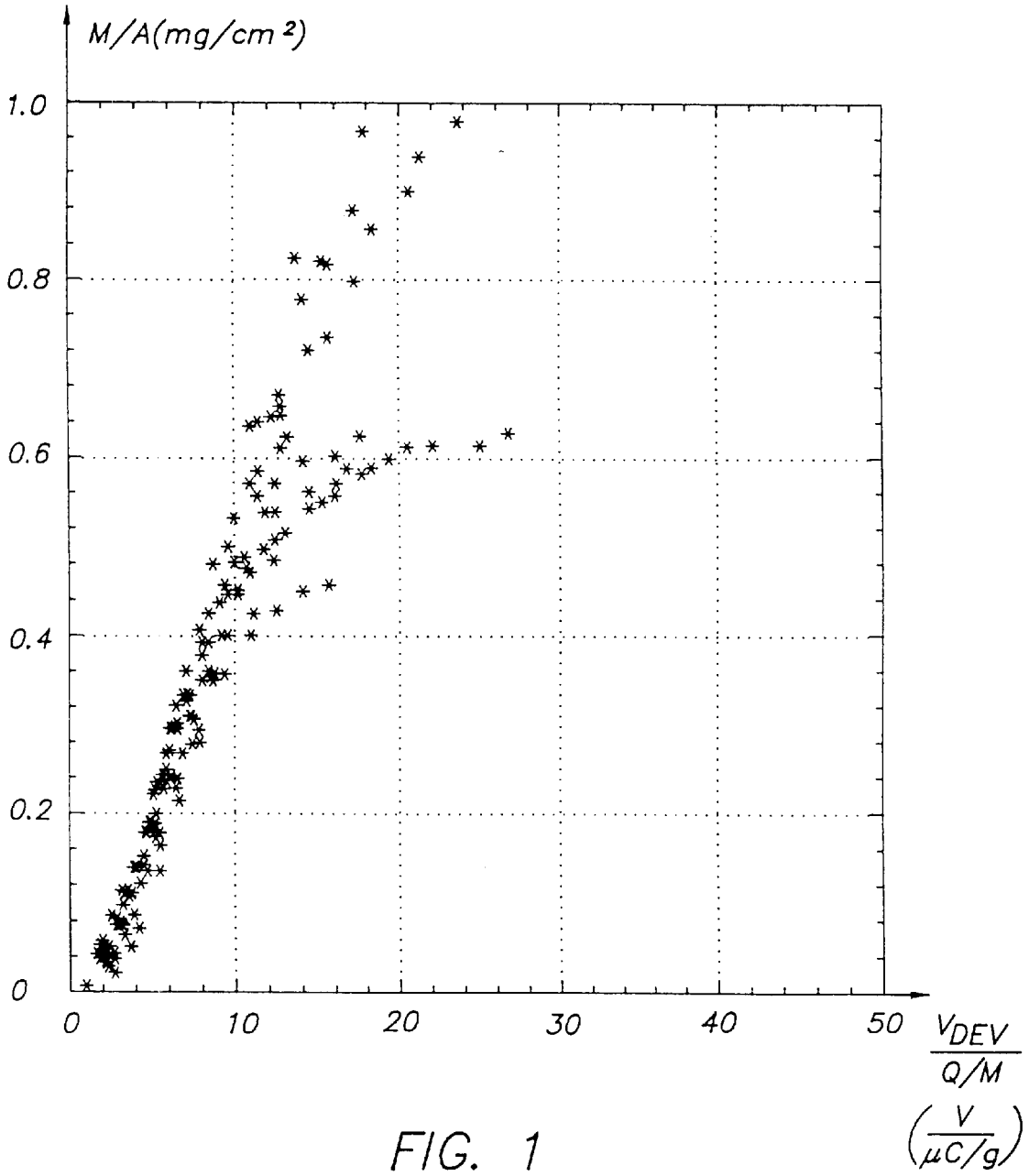
FIG. 1 is a graph representing measured points of developability curves typical for a two-component developer for various toner concentration values TC and different relative humidity values RH.

As described above, the density $D_{OPC}$ of the developed image on the OPC can be measured online by a densitometer 6. The development potential $V_{DEV}$ may be measured by a contact-less electrostatic voltage sensor 4. The graph in FIG. 1 represents a set of values for deposited toner mass M/A in a small, rectangular image or patch, homogeneously exposed over its complete area i.e. full density patch. This deposited toner mass M/A is measured for different toner concentrations TC and different relative humidity RH, for a range of values of the development potential $V_{DEV}$, divided by the actual toner charge Q/M at which development took place. All data are experimental. From FIG. 1 it can be seen, that for low deposited toner mass M/A values (below approximately 0.4 mg/cm$^2$), the toner mass M/A is, to a certain extent, independent of toner concentration TC or relative humidity RH. As a consequence, by developing a full density patch with a M/A within the range of e.g. 0.1 to 0.4 i.e. the linear part of the developability curve, and by measuring both the development potential $V_{DEV}$—indirectly by measuring $V_E$—and the toner mass M/A, the almost linear relationship between M/A and $V_{DEV}$/(Q/M), allows to easily extract charge information with a reasonable accuracy i.e. better than 10%. This is regarded as being sufficient.

Stabilizing developability

Figure 2:
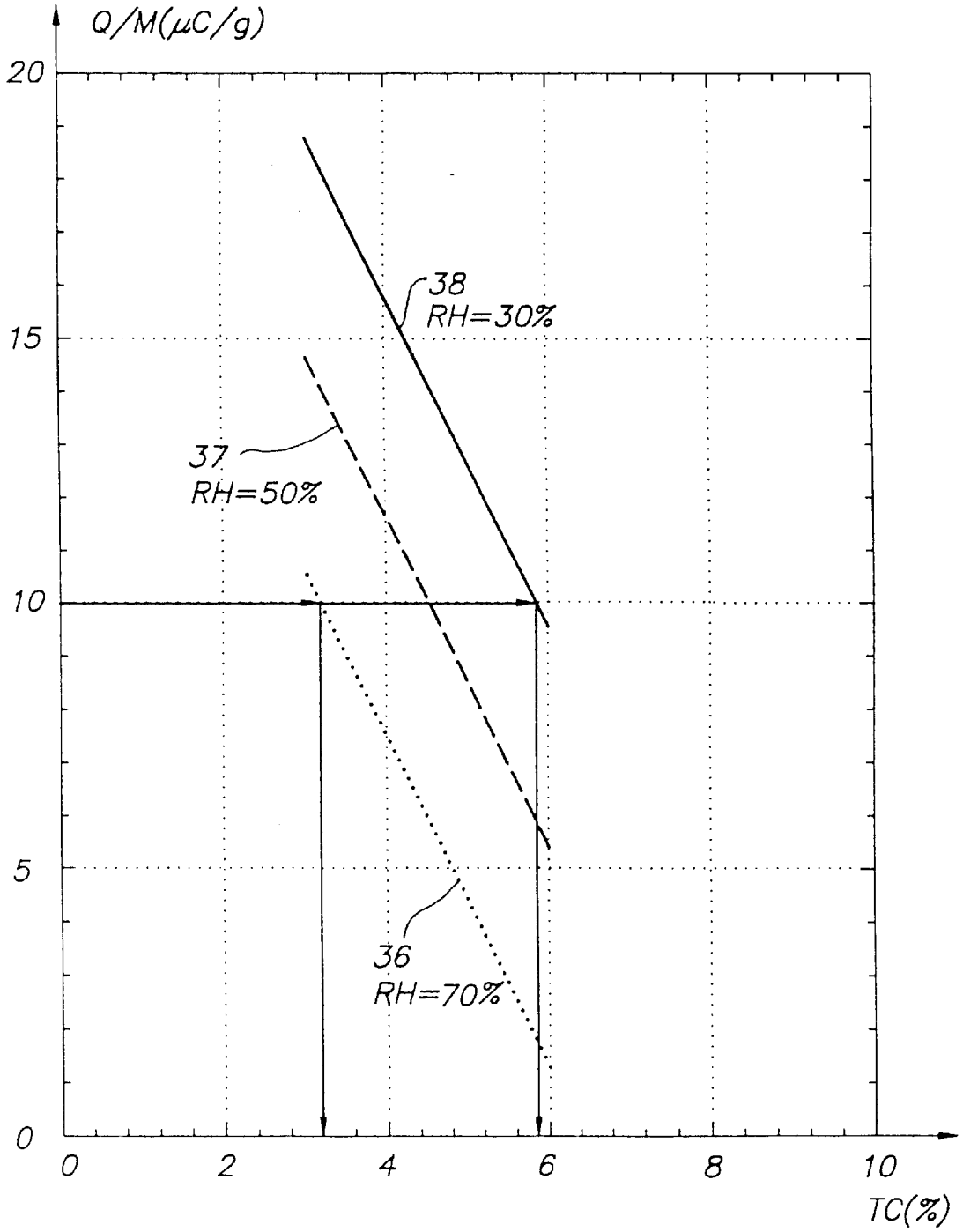
FIG. 2 is a graph representing the toner charge per unit of mass Q/M of the toner in a two-component developer system as a function of the toner concentration TC, with relative humidity RH as parameter.

FIG. 2 shows the toner charge per unit of mass Q/M as a function of toner concentration TC for different values of the relative humidity RH.

Curve 36 represents Q/M=f(TC) for RH=70%;

curve 37 represents Q/M=f(TC) for RH=50%;

curve 38 represents Q/M=f(TC) for RH=30%.

As stated earlier, both the developing process and the transfer process benefit from a stable charge level Q/M of the toner. It is the aim of the process control to maintain toner charge Q/M at one level for all environmental conditions. The applied method will be explained below.

Figure 4:
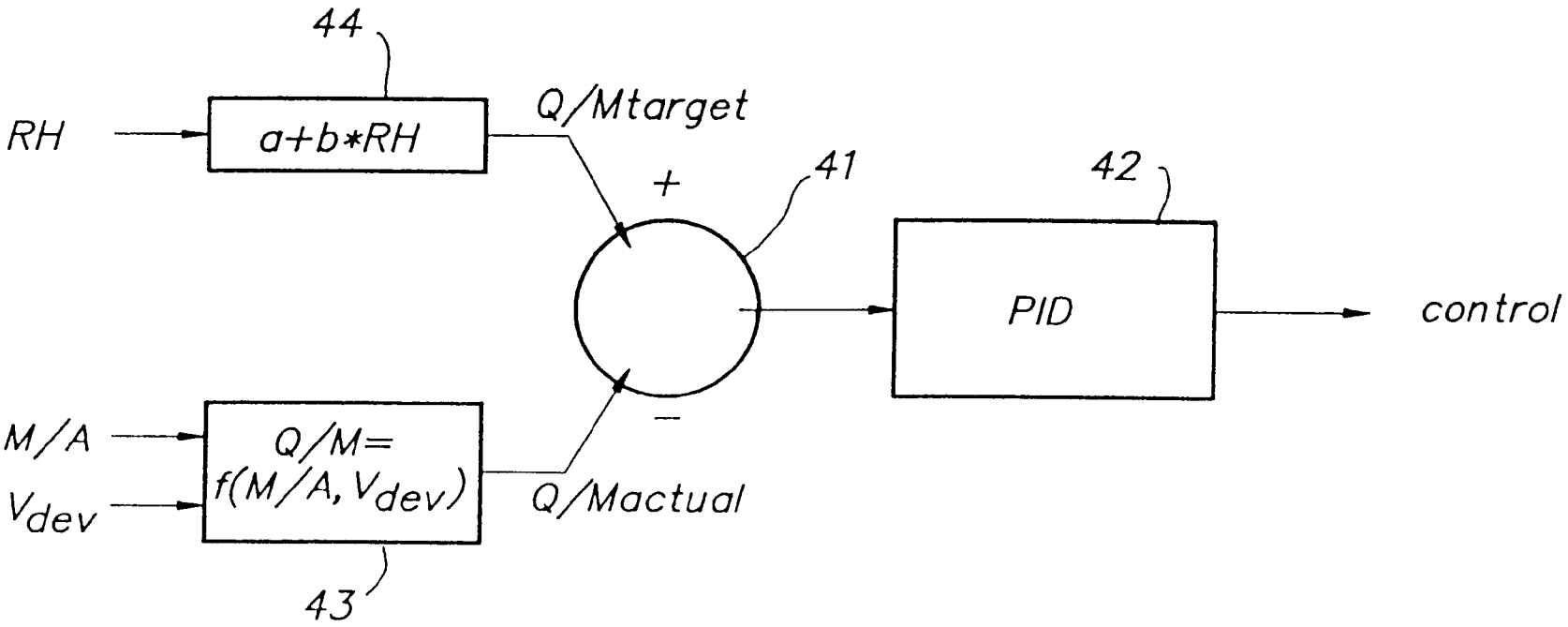
FIG. 4 represents a closed loop control system for regulating toner charge Q/M.

From FIG. 2, it can be seen that maintaining toner charge Q/M at one level would require a very wide range of toner concentration TC values to operate in. For instance, keeping the charge at 10 $\mu$C/g on the vertical Q/M axis, requires an operative range of 3% to 6% in TC on the horizontal axis. Extreme toner concentration values lead to negative effects on the quality of the developer, for instance shorter lifetime, which have to be avoided. Therefore, the target value of the toner charge Q/M is preferably made dependent on the actual relative humidity of the environment. The relative humidity RH is preferably measured by the environmental RH/T sensor 9:

$$(Q/M)_{target}=a+b.\mathrm{RH}$$

where a and b are constants to be chosen based on the actual characteristics of the developer. So, by measuring the toner charge Q/M in the way described earlier and calculating the target value $(Q/M)_{target}$ based on the environmental relative humidity RH, a closed loop control system can be devised as depicted in FIG. 4. The actual toner charge $(Q/M)_{actual}$ is calculated by the block 43. The target Q/M is calculated by the block 44. The target and actual toner charge are compared by the comparator 41. Through a control algorithm 42 such as a PID controller, the process control decides on which corrective action to take:

add toner to increase toner concentration TC; or, deplete toner to decrease the toner concentration TC. This can be achieved by developing a dummy image and dumping the toner into the toner waste box 10, or—which is the preferred method—not adding toner while images are being made.

In this way, toner concentration TC is always set at the most optimum value for all environmental conditions.

Stabilization of microscopic gradation

The FIG. 5*a* to 5*f* present the relationship between exposure energy $E_{EXP}$ and the discharge potential $V_E$, development potential $V_{DEV}$ and density $D_{TRANS}$ on paper for two different values of the charge potential $V_C$=−300 V, −500 V.

The relationship is shown between exposure energy $E_{EXP}$ and:

Charge potential $V_C$, bias potential $V_B$ , potential after exposure $V_E$ in FIG. 5*a* for $V_C$=−300 V and in FIG. 5*d* for $V_C$=−500 V;

development potential $V_{DEV}=V_E-V_B$ for $V_C$=−300 V in FIG. 5*b* and for $V_C$=−500 V in FIG. 5*e;* transmission density of an evenly exposed patch $D_{TRANS}$ for $V_C$=−300 V in FIG. 5*c* and for $V_C$=−500 V in FIG. 5*f*.

From the graphs it becomes very clear that the relationship between exposure energy $E_{EXP}$ and the resulting transmission density $D_{TRANS}$ changes drastically:

The minimum exposure energy $E_{MIN}$, shown in FIG. 5*b* and FIG. 5*e*, that will cause toner to be transferred to the OPC moves from a value of about 3 mJ/m$^2$ (FIG. 5*b* and FIG. 5*c*) to less than 2 mJ/m$^2$ (FIG. 5*e* and FIG. 5*f*)

an exposure energy $E_{EXP}$ of 10 mJ/m$^2$ on the OPC results in a density of 0.8 (FIG. 5*c*) while in the graph of FIG. 5*f* resulting from the same exposure level $E_{EXP}$=10 mJ/m$^2$ but starting from another charge potential $V_C$=−500 V the density is about 1.7.

This means that, as the charging potential $V_C$ is being changed in order to maintain the required density $D_{TRANS}$ as the toner charge Q/M and toner supply TS change, the exposure energy levels $E_{EXPi}$ that correspond to each of the microscopic tones $I_i$ have to be redefined, in order for the microscopic gradation to remain the same. Several methods can be used for redefining the exposure levels. A first way to do this is to develop a wedge of, for instance, 10 patches, each patch being homogeneously exposed by a different exposure energy $E_{EXPi}$, I=1 . . . 10. $E_{EXPi}$ may be expressed in % of the available range $E_{MAX}$ for a certain exposure device. The number of patches does not have to correspond to the number of bits/pixel that the engine can produce. The number of patches may be freely chosen depending on the required accuracy of the microscopic gradation calibration. The higher the number the higher the accuracy of the procedure, as described. The wedge may be preferentially measured online by the densitometer 6. The results of such measurement are presented in a graph in FIG. 6. The wedge can be generated at start-up, at regular time intervals after start-up, or after a certain number of prints, or when operating points of the engine have changed significantly, or any combination of these criteria, whatever is appropriate according to the stability of the engine's components. At factory calibration of the engine, a table is preferentially stored in the memory of the controlling microprocessor. This table contains the required output values $(D_{OPCi})_{RQ}$ of the densitometer 6 for each of the microscopic density levels. For instance, in a 4 bit/pixel engine, 16 microscopic density levels $(D_{OPCi})_{RQ}$ can be produced (including density 0). By taking the inverse function of the graph presented in FIG. 6, it is possible to calculate for each entry $D_{OPCi}$ in the table the corresponding exposure energy $E_{EXPi}$,as shown graphically for one value in FIG. 6. On the vertical $D_{OPC}$ axis the required target density value $D_{OPC}$ 17 is indicated. Via the sensitometric curve 19 in FIG. 6 $D_{OPC}$=f ($E_{EXP}/E_{MAX}$), one can find the corresponding required exposure energy level 18 to achieve the target density $D_{OPC}$ 17. The exposure level is given as a percentage with respect to $E_{MAX}$: the maximum exposure energy level. These values may then be stored in the look-up table (LUT) 15, located in the control electronics of the exposure device.

A second way to re-calibrate the microscopic gradation, is to expose for i=0 . . . 15 to $E_{EXPi}$ but not develop a similar wedge as the one described above. By means of the electrostatic voltage sensor 4 the development potentials $V_{DEVi}$ for each of the patches i can be recorded. This allows to construct a graph similar to the one described in FIG. 6.

Preferably, again at factory calibration of the engine, the required development potentials $V_{DEVi}$ are stored in a table resident in the memory of the controlling microprocessor. By taking the inverse of the recorded function, the required exposure energy level $E_{EXPi}$ for each of the entries in the table can be found and stored in a LUT 15 inside the exposure device.

Having described in detail preferred embodiments of the current invention, it will now be apparent to those skilled in the art that numerous modifications can be made therein without departing from the scope of the invention as defined in the following claims.

We claim:

1. A method for controlling output density in an electrophotographic device having a photosensitive element, said method comprising the following steps:

establishing a relation between optical density $D_{OPC}$, development voltage $V_{DEV}$ and toner charge Q/M;

generating on said photosensitive element an electrostatic patch, corresponding to medium optical density;

determining $V_{DEV}$ by determining potential after exposure $V_E$ of said electrostatic patch, determining a bias potential $V_B$ of a toner supply means, and determining a difference between $V_E$ and $V_B$;

developing said electrostatic patch by application of toner, giving a toner patch on said photosensitive element;

measuring the optical density $D_{OPC}$ of said toner patch;

computing, using said relation, from said development voltage and said optical density, the toner charge Q/M; and, modifying toner concentration TC in correspondence with said computer toner charge Q/M.

2. Method according to claim 1, wherein modification of said toner concentration TC comprises the steps of increasing or decreasing toner supply TS.

3. Method according to claim 1, wherein determining the development voltage $V_{DEV}$ comprises the steps of:

measuring potential after exposure $V_E$ of said electrostatic patch;

finding bias potential $V_B$ of said toner supply means;

making the difference between $V_E$ and $V_B$.

4. Method according to claim 1, wherein the step of modifying said toner concentration TC is based on a target toner charge $(Q/M)_{TARGET}$.

5. Method according to claim 4, wherein said target toner charge $(Q/M)_{TARGET}$ is computed comprising the following steps:

establishing a second relation between relative humidity RH and target toner charge;

measuring a relative humidity RH;

computing using said second relation, from said measured relative humidity, the target toner charge $(Q/M)_{TARGET}$.

6. Method according to claim 4, comprising the steps of:

regularly computing the Q/M and $(Q/M)_{TARGET}$ values;

using these values in a PID system to compute the required TC change.

7. Method according to claim 1, comprising the step of exposing a plurality of patches on said photoconductive element to different exposure levels $E_{EXPi}$ constant within each patch.

8. Method according to claim 7, further comprising the steps of:

developing said patches by application of toner;

measuring the optical density of each patch by a densitometer;

establishing a conversion table giving exposure level as a function of required optical density, based on said measured optical density.

9. Method according to claim 7, further comprising the steps of:

measuring the voltage level of said exposed patches;

establishing a conversion table giving exposure level as a function of required optical density, based on said measured voltage level.

* * * * *